US009657911B2

(12) United States Patent
Aubry et al.

(10) Patent No.: US 9,657,911 B2
(45) Date of Patent: May 23, 2017

(54) SPOTLIGHT FOR A MOTOR VEHICLE

(71) Applicant: AML SYSTEMS, Paris (FR)

(72) Inventors: Alexandre Aubry, Paris (FR); Hassan Koulouh, Le Pré Saint Gervais (FR); Cyril Rivier, Courbevoie (FR)

(73) Assignee: AML SYSTEMS, Paris (FR)

( * ) Notice: Subject to any disclaimer, the term of this patent is extended or adjusted under 35 U.S.C. 154(b) by 689 days.

(21) Appl. No.: 14/153,681

(22) Filed: Jan. 13, 2014

(65) Prior Publication Data

US 2014/0198514 A1 Jul. 17, 2014

(30) Foreign Application Priority Data

Jan. 14, 2013 (FR) ..... 13 50286

(51) Int. Cl.
*F21S 8/10* (2006.01)

(52) U.S. Cl.
CPC ..... *F21S 48/12* (2013.01); *F21S 48/1154* (2013.01); *F21S 48/1721* (2013.01); *F21S 48/321* (2013.01)

(58) Field of Classification Search
CPC .... F21S 48/12; F21S 48/1154; F21S 48/1721; F21S 48/321
See application file for complete search history.

(56) References Cited

FOREIGN PATENT DOCUMENTS

| | | | | |
|---|---|---|---|---|
| EP | 1 234 716 A2 | 8/2002 | | |
| FR | 2 925 948 A1 | 7/2009 | | |
| WO | WO 2012/098142 A1 | 7/2012 | | |
| WO | WO 2012098142 A1 * | 7/2012 | ..... | B60Q 1/076 |

* cited by examiner

*Primary Examiner* — David V Bruce
(74) *Attorney, Agent, or Firm* — Blank Rome LLP

(57) ABSTRACT

The invention relates to a spotlight (2) for a motor vehicle that has a light source (4) producing a beam of light which is directed along a first axis (X) intended to be oriented towards the front of the vehicle and a lens (6), wherein the light source (4) projects all of the beam directly onto the lens (6) without reflection nor obturation, and the lens (6) is arranged to move in rotation about a second axis (Z) intended to be oriented towards the top of the vehicle.

12 Claims, 3 Drawing Sheets

Figure 2:
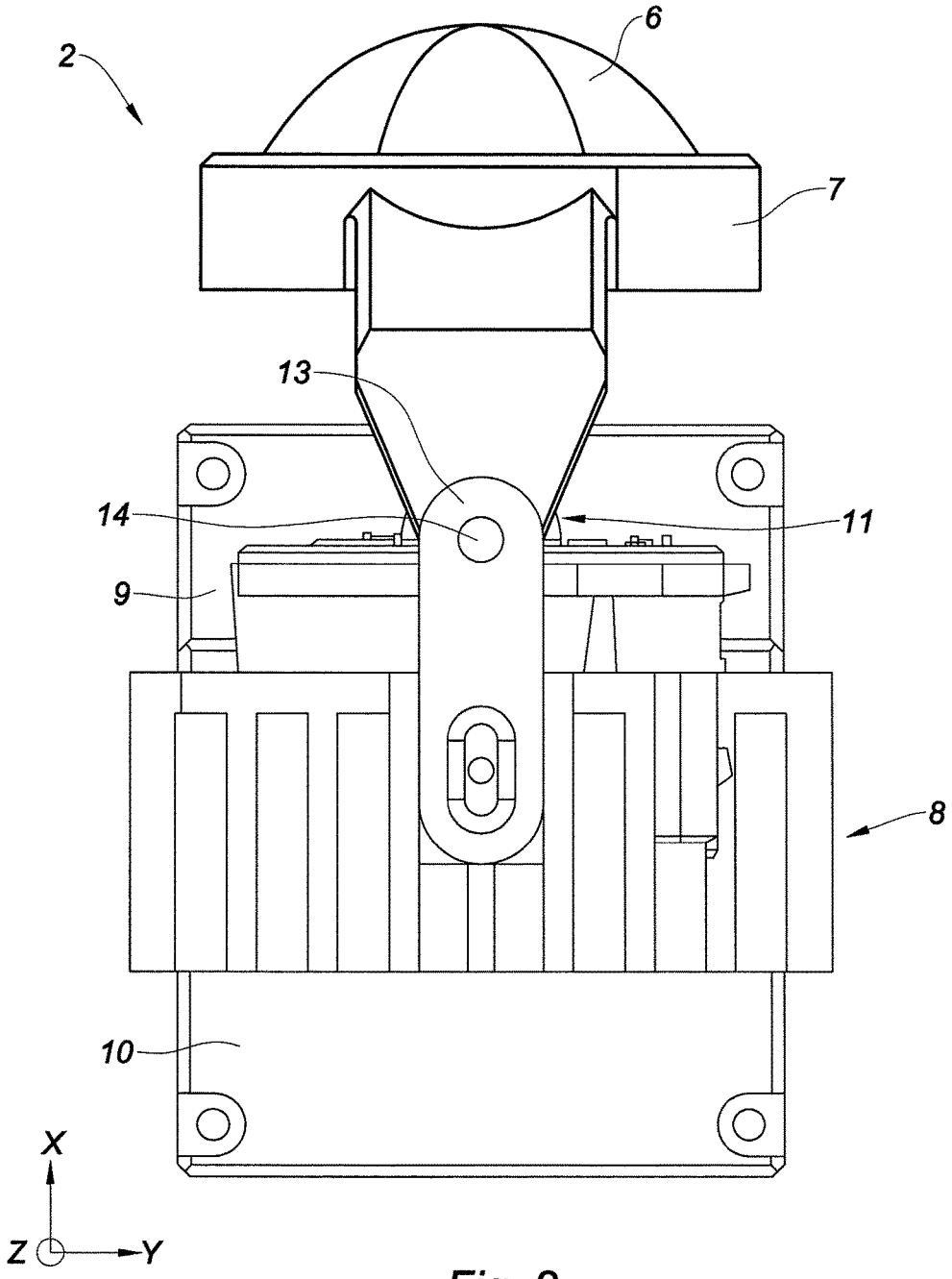

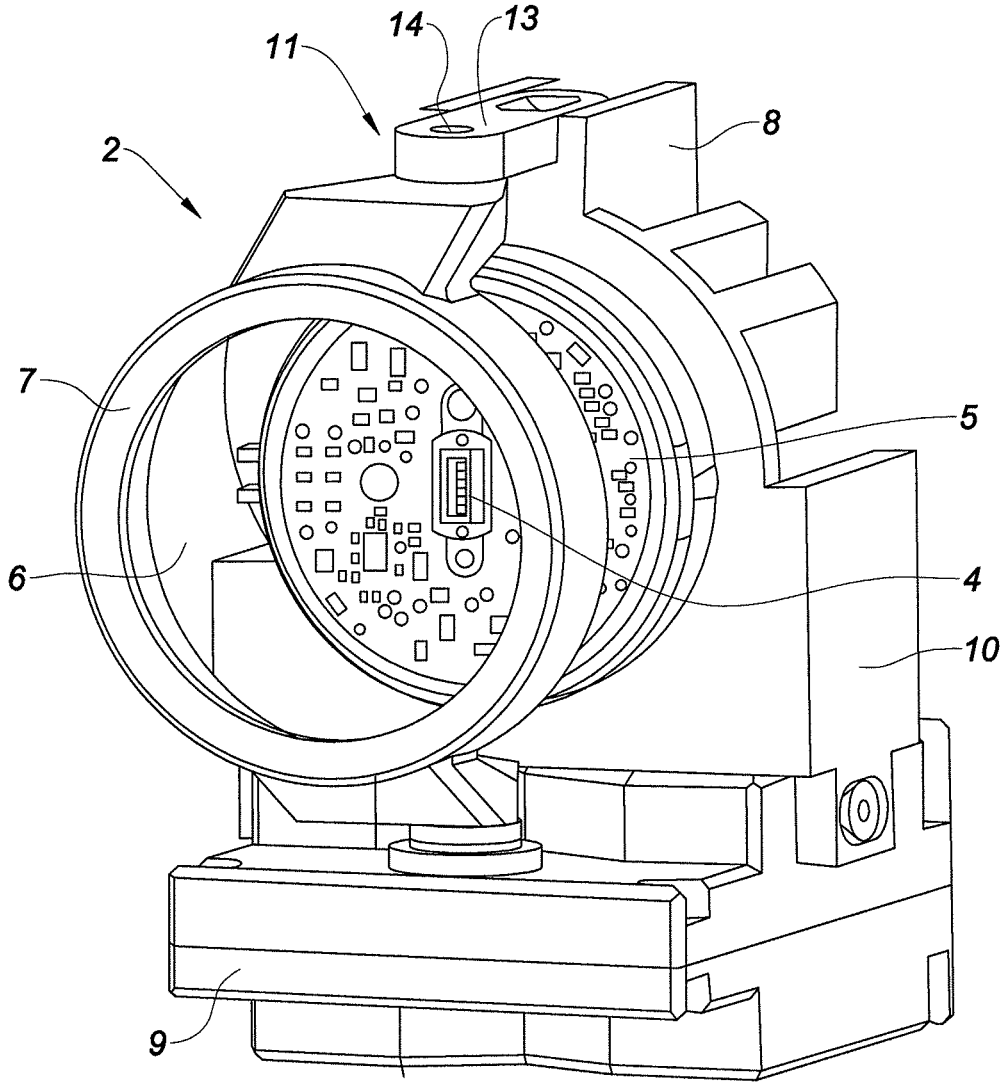
Fig. 1
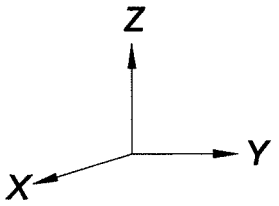

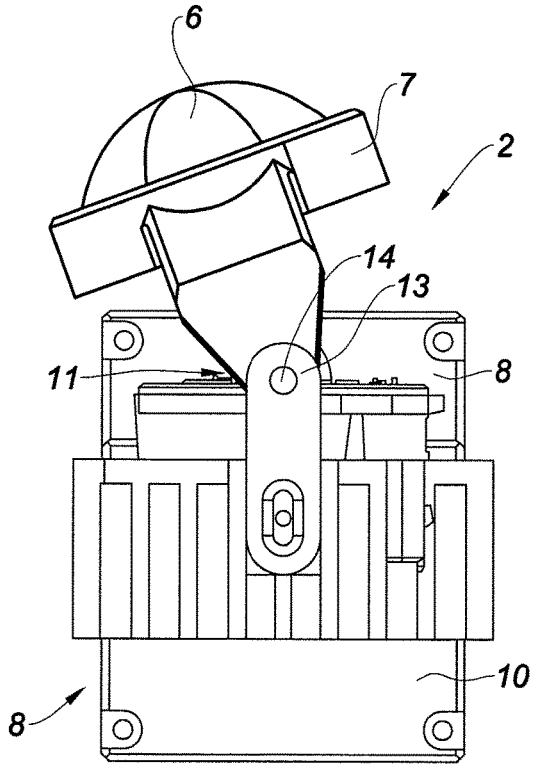
Fig. 3a
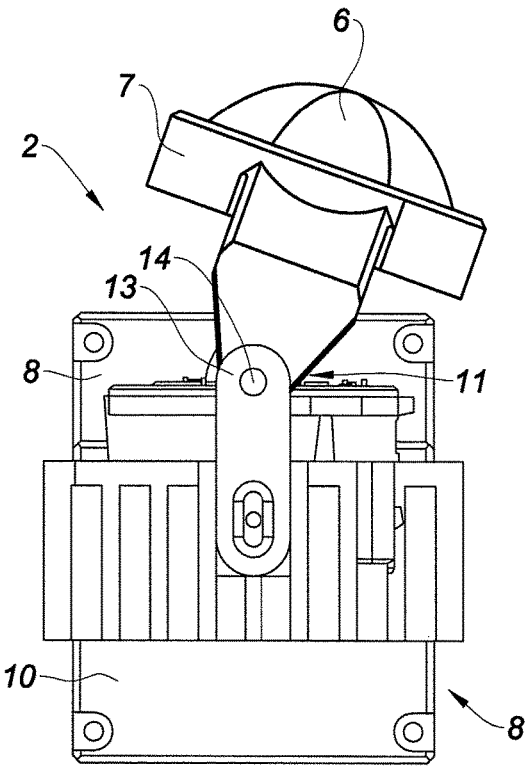
Fig. 3b
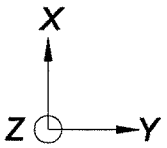

SPOTLIGHT FOR A MOTOR VEHICLE

The field of the invention is that of headlamps for motor vehicles.

A headlamp generally comprises a light source producing a light beam and means for movement and/or deformation of the light beam in order to adapt it to the circumstances of driving.

The invention relates more particularly to headlamps of the spotlight type which are capable of continuously directing the light beam produced, in addition to the usual main beam, towards an identified object present on, or in the vicinity of, the path of the vehicle.

Driver assistance systems are known which make it possible to detect a potential obstacle, for example a pedestrian or an animal, on the road. These systems are useful in a dark environment, for example at night or in a tunnel, and generally comprise a sensor, of the infrared camera type, which detects the presence of such an obstacle. A light source is then controlled to illuminate the obstacle and an actuator causes the spotlight assembly to move so that the beam follows the obstacle.

Given that the vehicle and the obstacle may be moving simultaneously in different directions, the light source must move quickly so that the obstacle remains illuminated and it is thus necessary to have an actuator capable of precisely and rapidly causing the spotlight to move. However, such actuators are complex and bulky.

In the field of elliptical headlamps intended to illuminate the road, it is known, in order to direct the beam at bends, to pivot not the entire elliptical headlamp but only the lens. However, this type of solution presents difficulties in application since the light beam is deformed during the movement of the lens. As a result the light/dark boundary can no longer comply with the standards in force for headlamps intended to illuminate the road. Solutions exist for controlling the position of the light/dark boundary when the lens is moved but they involve the presence in the elliptical headlamp of complex optical elements which deflect the beam before it reaches the lens.

Thus the invention seeks to improve the situation by proposing a spotlight for a motor vehicle, comprising a light source producing a beam of light which is directed along a first axis intended to be oriented towards the front of the vehicle, said spotlight comprising a lens, characterised in that said light source projects all of the beam directly onto the lens, without reflection nor obturation, said lens being arranged to move in rotation about a second axis intended to be oriented towards the top of the vehicle.

Thus, the light beam is projected directly onto the lens and is never reflected on its path between the light source and the lens. Therefore the spotlight does not comprise an optical element between the light source and the lens and thus the invention makes it possible to obtain a simplified spotlight.

Furthermore, only the lens has to be moved in order to make the beam turn. The rotation about the vertical axis makes it possible to move the light beam so that it continuously illuminates a particular object, for example an obstacle on the road both when the vehicle is stationary and when it is moving. Since the mass of the lens is less than that of the spotlight assembly, it will be possible to use a more compact actuation system and/or to move the lens more quickly.

The slight deformation of the beam directed by the lens is not inconvenient here since the light/dark boundary does not have to comply with the same regulations as those existing for elliptical headlamps intended to illuminate the road.

According to one aspect of the invention, said light beam has a shape which is substantially elongated along the second axis. The deformation of a beam which is due to the displacement of the lens is greater in the region of the top end of the beam than in the regions of the lateral extremities which are barely modified. Thus the lateral range of the beam is barely modified by the rotation of the lens, and the spotlight according to the invention therefore makes it possible to precisely target objects situated at the edge of the road without the deformations of the beam causing problems.

Thus, the verticality of the beam makes it possible to illuminate any obstacle by carrying out only one rotation about a vertical axis. In fact, the spotlight is thus capable of illuminating objects both close to and distant from the vehicle, or of following the evolution of the obstacle relative to the vehicle by carrying out a rotation about a single axis of rotation.

In one aspect of the invention, the light beam is projected by the lens and forms an image included in a rectangle in a plane perpendicular to the first axis, the large sides of the rectangle extending along the second axis and the short sides of the rectangle extending along a third axis perpendicular to the first axis and the second axis. One thus obtains a vertical beam to target objects near and far from the vehicle by performing a rotation around a single axis of rotation, that is to say the second axis. By included in a rectangle we mean a shape, preferably convex, that is tangential to the four sides of said rectangle.

Advantageously, the length of the large sides is 2 to 10 times greater than the length of the short sides, in particular 4 to 6 times.

According to an exemplary embodiment, the light beam is projected by the lens and forms an image projected at a given length of the spot light measured along the first axis, the image having then a width measured along a third axis perpendicular to the first axis and the second axis which is comprised between 1 and 5% of said length.

According to an embodiment of the invention, the light source comprises at least one light-emitting diode. Light-emitting diodes are particularly advantageous since they are good sources of punctiform light.

In one aspect of the invention, the light source comprises a series of light-emitting diodes, disposed linearly along the second axis. These diodes aim at the optical axis of the lens when said lens in at rest.

Advantageously, the spotlight comprises a lighting module on which the light source is positioned.

According to an aspect of the invention, the lens is mounted on the lighting module by means of at least one joint which allows the lens to rotate relative to the lighting module along the second axis.

According to an embodiment of the invention, said spotlight comprises an actuator arranged to make said lens turnabout the second axis. By virtue of the invention, the actuator can be chosen to be more compact and lighter in order to make only the lens pivot.

The invention also relates to a headlamp for a motor vehicle comprising a spotlight such as that defined previously.

Finally, the invention relates to a motor vehicle comprising a spotlight such as that defined previously.

The invention will be better understood in the light of the following description which is given only by way of illustration and not for the purpose of limitation, accompanied by the appended drawings in which:

FIG. 1 shows a schematic perspective view of a spotlight according to an embodiment of the invention;

FIGS. 2, 3*a* and 3*b* show schematic views of the spotlight of FIG. 1 seen from above, with a lens respectively in the rest position and in its extreme rotational positions.

FIGS. 1, 2, 3*a* and 3*b* show an embodiment of the spotlight 2 for a motor vehicle according to the invention.

The spotlight 2 comprises a light source 4, in this case a light-emitting diode, and a lens 6 mounted on a lens support 7 disposed on a lighting module 8. The lighting module comprises a base 9 on which the lens support 7 is mounted, and a body 10 on which the light source is mounted. The light rays from the light source 4 are emitted directly in the direction of the lens 6 in order to form a light beam of very great intensity and of long range. It will be noted here that the beam is in no way deflected nor obstructed in its path between the light source 4 and the lens 6. In other words, the entire light beam emitted by the light source 4, that is to say, the totality of the light energy emitted by the source, not considering parasitic losses, is projected directly on the lens 6.

The light-emitting diode is arranged on a printed circuit board 5, situated in this case on the body 10 of the lighting module. The light beam produced by this light-emitting diode is directed along a first axis X oriented towards the front of the vehicle in order to optimally illuminate any obstacle situated on or at the side of the road taken by the vehicle. Orientation towards the front of the vehicle is understood to mean any direction starting from a plane perpendicular to a longitudinal axis of the vehicle and directed towards the front of the vehicle.

The spotlight 2 is intended to be used in a dark environment, for example at night or in a tunnel, to illuminate a potential obstacle moving on the road or at the edge of this road. This obstacle is for example a pedestrian or an animal which may for example be on the point of crossing the road or already in the process of crossing.

In order to be able to continuously illuminate this moving obstacle, the vehicle itself being in movement, the lens 6 is arranged to turnabout a second axis Z oriented towards the top of the vehicle. The second axis is in particular vertical and in particular perpendicular to the first axis. The beam can thus be directed to either side of the road. The light beam is also elongated along the second axis Z, so that the spotlight 2 can illuminate obstacles, situated laterally, close to or distant from the vehicle by carrying out a rotation of the lens solely along one axis, namely the second axis Z. For this, the light source here comprises a series of light-emitting diodes, disposed linearly along the second vertical axis Z; they aim at the optical axis of the lens 6. The optical axis 6 is defined here when the lens is in the rest position, that is to say when it is not rotated to illuminate an obstacle. The optical axis is then aligned with the light source.

By light beam elongated along the second axis Z, we mean an elongated light beam such that the image projected on a plane perpendicular to the first axis X and located forward of the spotlight is included in a vertical rectangle, that is to say elongated along the second axis Z. Advantageously, the vertical rectangle comprises large sides, measured along the second axis Z, 2 to 10 times greater than the short sides of the rectangle measured along a third axis Y, in particular perpendicular to the first axis X and the second axis Z. For example, in the case of illumination of 1 to 2 m wide on a vertical wall located 50 m from the projector, the illumination will be from 2 to 20 m high.

We will choose preferably a rectangle whose length of the large sides is much larger than the short sides, for example, ten times larger, in the case where it is desired that the distance between the vehicle comprising the spotlight of the invention and the first impact point of the beam on the ground is low while illuminating an obstacle to either short or long-distance from the spotlight. Indeed, the spotlight of the invention is particularly advantageous when the driver can see a line on the ground indicating the direction of the obstacle to avoid.

Instead, it is also possible to reduce the ground markings by providing a rectangle whose length of the large sides is slightly greater than that of the short sides, for example, two times greater, in case it is desired to lower road illumination.

Advantageously, the image of the beam projected by the lens has a width of between 1 to 5%, that is to say, the image of the beam projected by the lens on a wall located 100 meters from the spotlight has a width of 1 meter to 5 meters.

For example for a target located at 50 meters it provides an illumination of 0.5 to 2.5 meters wide, which is enough to mark an obstacle on the side of the road, including pedestrians.

In order to enable this rotation, the lens support 7 is mounted so as to rotate freely on the lighting module 8 between two joints 11, 12. Thus the spotlight according to the invention has a first rotary joint 11 between the lens support 7 and the lighting module 8, which is situated above the lens along the second axis Z, and a second rotary joint 12 between the lens support 7 and the lighting module 8, which is situated below the lens along the second axis Z. The first joint 11, the second joint 12 and the optical axis of the lens 6 are aligned along the second axis Z.

The third axis Y, which is in particular perpendicular to the first axis X and to the second axis Z defines the horizontal with the axis X.

The first joint 11 is formed here by a projection 13 from the lighting module 8 and a pin 14 of the lens support 7 inserted in the projection 13.

The second joint 12 is formed in particular by a pin of the lens support 7 and an opening situated on the base 9 of the lighting module 8.

The pin of the first joint 11 and that of the second joint 12 are aligned along the second axis Z and thus enable the lens 6 to turnabout this axis.

FIGS. 1 and 2 illustrate the case where the lens is centred with respect to the spotlight, that is to say the case where the beam issuing from the lens is directed straight in front of the vehicle. FIGS. 3*a* and 3*b* illustrate the cases in which the actuator has set the lens 6 into rotation, in particular in order to follow an obstacle. In such a case the beam is slightly deformed, but the parasitic light which results from it and which develops principally at its top and bottom ends does not pose any problem here since it cannot dazzle passengers in vehicles travelling in the opposite direction.

The spotlight 2 according to the invention can be controlled by a driver assistance system. Such a driver assistance system comprises image detection means comprising at least one sensor which collects information relating to the environment in which the vehicle is moving. This sensor is in particular an infrared camera directed in the direction of movement of the vehicle in order to cover a distance which can be as much as several hundred meters in front of the vehicle.

The detection means supply at the output at least one signal comprising data of the detected image to image processing means.

The image processing means here comprise a real time video processor arranged to process quickly, for example in less than a tenth of a second, the image data collected by the detection means. This processor is also capable of identifying different types of objects on the road, discriminating between stationary objects and moving objects and calculating the trajectory of the latter.

Thus, when the image processing means identify an obstacle, such as an animal or a pedestrian, moving on the road or in the vicinity of the road, they calculate its trajectory and supply its position in real time to means for controlling the assembly for actuation of the spotlight 2 in order to position the light beam produced by the source 4 in an appropriate manner to illuminate the obstacle.

Then, depending upon the movement of the obstacle and of the vehicle, the control means control the motor of the actuation assembly in order to set the lens 6 into rotation.

Of course, other embodiments can still be envisaged.

Thus, the spotlight of the invention may form an entirely separate headlamp, in particular intended for the tracking obstacles. It may also form part of an existing headlamp, in particular a fog lamp.

The invention claimed is:

1. Spotlight for a motor vehicle, comprising a light source producing a beam of light directed along a first axis, said spotlight comprising a lens, characterized in that said light source projects the beam directly onto the lens, said lens being arranged to move in rotation about a second axis generally perpendicular to the first axis, said light beam having a shape which is substantially elongated along the second axis.

2. Spotlight according to claim 1, wherein said light beam is projected by the lens and forms an image included in a rectangular shape having two short sides and two long sides in a plane perpendicular to the first axis, the long sides of the rectangle extending along the second axis and the short sides of the rectangle extending along a third axis perpendicular to the first axis and the second axis.

3. Spotlight according to claim 2, wherein the length of the long sides is 2 to 10 times greater than the length of the short sides.

4. Spotlight according to claim 1, wherein the light beam is projected by the lens and forms an image projected at a given length of the spot light measured along the first axis, the image having a width measured along a third axis perpendicular to the first axis and the second axis which is comprised between 1 and 5% of said length.

5. Spotlight according to claim 1, wherein the light source comprises at least one light-emitting diode.

6. Spotlight according to claim 5, wherein the light source comprises a series of light-emitting diodes, disposed linearly along the second axis.

7. Spotlight according to claim 1, comprising a lighting module on which the light source is positioned.

8. Spotlight according to claim 7, wherein the lens is mounted on the lighting module by means of at least one joint which allows the lens to rotate relative to the lighting module along the second axis.

9. Spotlight according to claim 1, comprising an actuator arranged to make said lens turnabout the second axis.

10. Headlamp for a motor vehicle comprising a spotlight according to claim 1.

11. Motor vehicle comprising a spotlight according to claim 1 wherein the motor vehicle has a front and a top and first axis is oriented toward the front of the vehicle and second axis is oriented toward the top of the vehicle.

12. Spotlight according to claim 1, wherein the lens is mounted on a lens support disposed on a lighting module, the lens support being mounted so as to rotate freely on the lighting module between two joints, both joints and the optical axis of the lens being aligned along the second axis.

* * * * *